US007322071B2

(12) United States Patent
Lee et al.

(10) Patent No.: US 7,322,071 B2
(45) Date of Patent: Jan. 29, 2008

(54) COMPLEX TYPE CLEANER

(75) Inventors: Yong-Woo Lee, Seoul (KR); Hyeun-Sik Nam, Seoul (KR); Choon-Myun Chung, Gyeonggi-Do (KR); Ho-Seon Rew, Seoul (KR)

(73) Assignee: LG Electronics Inc., Seoul (KR)

( * ) Notice: Subject to any disclaimer, the term of this patent is extended or adjusted under 35 U.S.C. 154(b) by 374 days.

(21) Appl. No.: 11/002,884

(22) Filed: Dec. 3, 2004

(65) Prior Publication Data

US 2005/0262657 A1 Dec. 1, 2005

(30) Foreign Application Priority Data

May 31, 2004 (KR) ..... 10-2004-0039354

(51) Int. Cl.
*A47L 7/00* (2006.01)

(52) U.S. Cl. ..... 15/320; 15/328; 15/353

(58) Field of Classification Search ..... None
See application file for complete search history.

(56) References Cited

U.S. PATENT DOCUMENTS 6,243,912 B1 * 6/2001 Grey ..... 15/320

* cited by examiner

*Primary Examiner*—David Redding
(74) *Attorney, Agent, or Firm*—Birch, Stewart, Kolasch & Birch, LLP

(57) ABSTRACT

A complex type cleaner comprises: a body; a suction head arranged at a lower side of the body, for sucking dust at the time of performing a vacuum cleaning and sucking dirty water at the time of performing a water cleaning; a suction fan for generating a suction force so that dust and dirty water can be sucked into the suction head; a reservoir detachably mounted at the body and storing dust or dirty water; and a valve assembly for converting a cleaning mode into a vacuum cleaning mode or a water cleaning mode by selectively opening and closing passages connected among the suction head, the reservoir, and the suction fan. A vacuum cleaning function for sucking dust and a water cleaning function are implemented at one cleaner, thereby reducing the cost and facilitating the usage and the storage.

17 Claims, 6 Drawing Sheets

COMPLEX TYPE CLEANER

BACKGROUND OF THE INVENTION

1. Field of the Invention

The present invention relates to a complex type cleaner, and more particularly, to a complex type cleaner capable of selectively performing a vacuum cleaning for sucking dust and foreign materials and a water cleaning.

2. Description of the Conventional Art

Generally, an upright type vacuum cleaner comprises: a body arranged as an upright state; a suction fan mounted in the body and generating a suction force; a filter container having a filter for collecting dust or foreign materials sucked by a suction force generated from the suction fan; a suction head arranged at a lower side of the body and sucking dust or foreign materials; and a brush rotatably installed at the suction head and brushing up dust and foreign materials of a floor.

In the upright type vacuum cleaner, as the suction fan is driven, a suction force is generated. By the suction force, dust and foreign materials of a floor or a carpet are sucked through the suction head, and filtered by the filter thus to be collected in the filter container.

Generally, a water extractor includes: a water supplying container for containing wash liquid; a pump for pumping the wash liquid contained in the water supplying container; a spray nozzle for spraying the wash liquid pumped by the pump to a part to be cleaned; a suction nozzle for sucking water and dust of the part to be cleaned to which the wash liquid has been applied by the spray nozzle; a water collecting container for containing dirty water sucked by the suction nozzle; and a suction fan for generating a suction force so that dirty water can be sucked to the suction nozzle.

In the water extractor, a pump is driven and thereby wash liquid contained in the water supplying container is sprayed to a carpet, etc. through the spray nozzle. Then, a brush brushes the carpet, etc. with being rotated, and dirty water is sucked through the suction nozzle thus to be collected in the water collecting container. At this time, air is exhausted to the outside.

In the conventional cleaner, a vacuum cleaner has to be provided in order to vacuum-clean dust and foreign materials, and a water cleaner has to be provided in order to water-clean a carpet, etc. That is, since two cleaners have to be provided for performing a cleaning, the cost is increased and a large storage space is required thereby to have inconvenience in storing the cleaners.

SUMMARY OF THE INVENTION

Therefore, an object of the present invention is to provide a complex type cleaner capable of reducing a cost and facilitating a usage and a storage by implementing a vacuum cleaning function for sucking dust and a water cleaning function at one cleaner.

Another object of the present invention is to provide a complex type cleaner capable of facilitating to convert a vacuum cleaning mode into a water cleaning mode or a water cleaning mode into a vacuum cleaning mode by being equipped with a valve assembly for converting into a vacuum cleaning mode or a water cleaning mode.

To achieve these and other advantages and in accordance with the purpose of the present invention, as embodied and broadly described herein, there is provided a complex type cleaner comprising: a body; a suction head arranged at a lower side of the body, for sucking dust at the time of performing a vacuum cleaning and sucking dirty water at the time of performing a water cleaning; a suction fan for generating a suction force so that dust and dirty water can be sucked into the suction head; a reservoir detachably mounted at the body and storing dust or dirty water; and a valve assembly for converting a cleaning mode into a vacuum cleaning mode or a water cleaning mode by selectively opening and closing passages connected among the suction head, the reservoir, and the suction fan.

The complex type cleaner further comprises a clean water spray device for spraying clean water to a carpet or a floor at the time of performing a water cleaning. The clean water spray device includes: a water tank mounted at a rear surface of the body and storing clean water; a clean water supplying line connected to the water tank and supplying clean water to the suction head; a pump installed at the clean water supplying line and pumping the clean water stored in the water tank; and a spray nozzle connected to the end of the clean water supplying line and spraying the clean water pumped by the pump to a carpet.

A dust suction opening for sucking dust and foreign materials is formed at a lower surface of the suction head, and a dust suction tube for guiding dust sucked into the dust suction opening to the reservoir is connected to a rear side of the suction head. Also, a suction nozzle for sucking water that has been used to remove foreign materials of the floor is installed at a front side of the suction head, and a water suction tube for guiding dirty water sucked into the suction nozzle into the reservoir is connected to the suction nozzle.

The reservoir includes: a container mounted at the body and having a space for storing dust or water therein; a cover mounted at an opened upper surface of the container; an inlet formed at the cover and selectively connected to a dust suction tube or a water suction tube by the valve assembly, for introducing dust or water into the container; a first outlet formed at the cover and exhausting air inside the container when dust is introduced to the container through the inlet; and a second outlet formed at the cover and exhausting air inside the container when dirty water is introduced to the container through the inlet.

The valve assembly includes: a valve housing composed of a first connection port mounted at the body and connected to a dust suction tube for sucking dust, a second connection port connected to a water suction tube for sucking water, a third connection port to which a discharge tube connected to the suction fan is connected, a fourth connection port to which a first tube connected to the inlet is connected, a fifth connection port to which a second tube connected to the first outlet is connected, and a sixth connection port to which a third tube connected to the second outlet is connected; a switching valve rotatably mounted at an inner circumferential surface of the valve housing and having a first conduit for selectively connecting between the first connection port and the fourth connection port or between the third connection port and the sixth connection port, and a second conduit for selectively connecting between the third connection port and the fifth connection port or between the second connection port and the fourth connection port; and a valve cover mounted at the valve housing and limiting a rotation range of the switching valve.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a preferred embodiment of a complex type cleaner according to the present invention will be explained with reference to the attached drawings as follows.

Even if there are a plurality of preferred embodiments of the complex type cleaner according to the present invention, the most preferred embodiment will be explained hereinafter.

Figure 1:
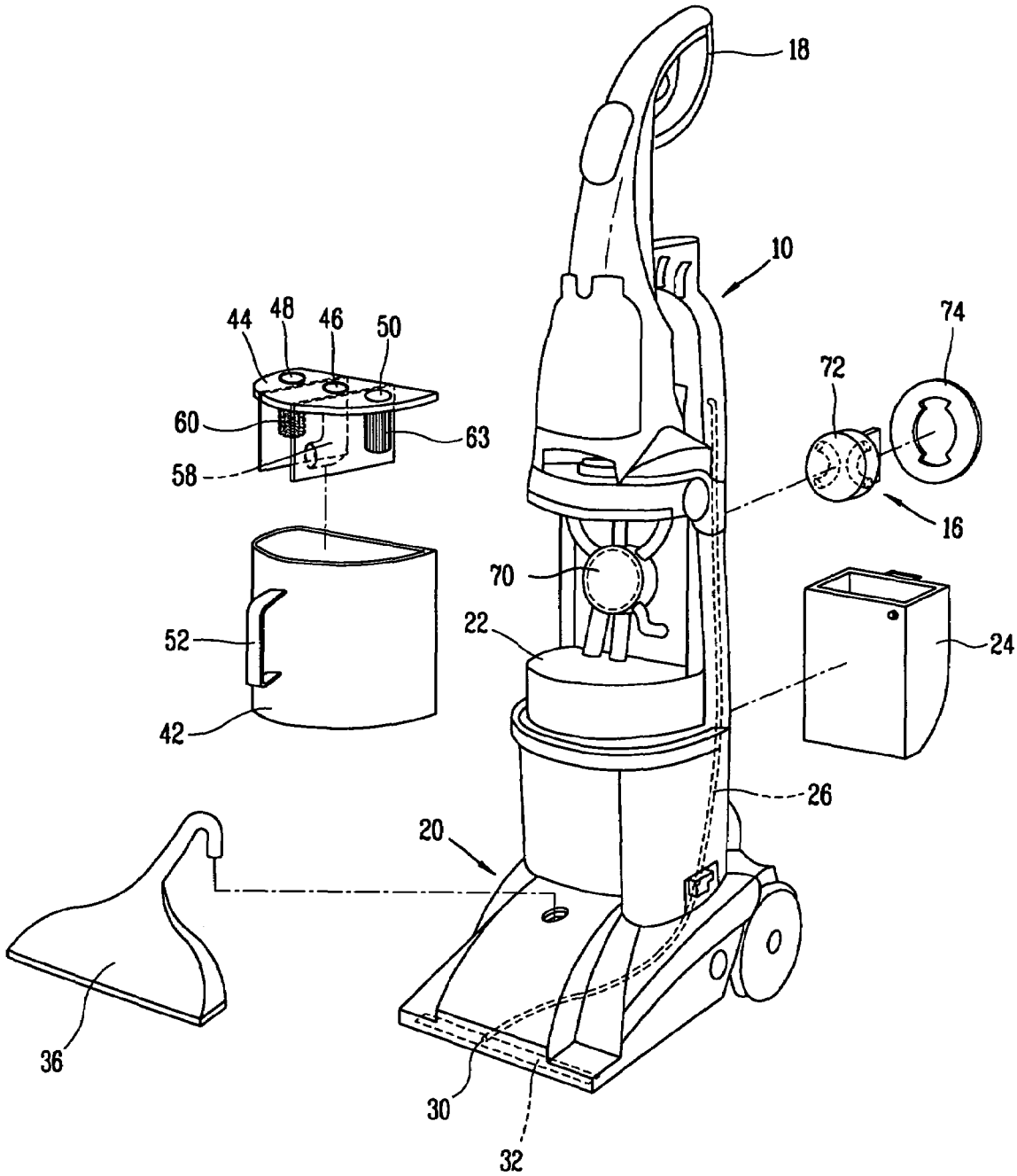
FIG. 1 is a disassembled perspective view showing a complex type cleaner according to one embodiment of the present invention.
Figure 2:
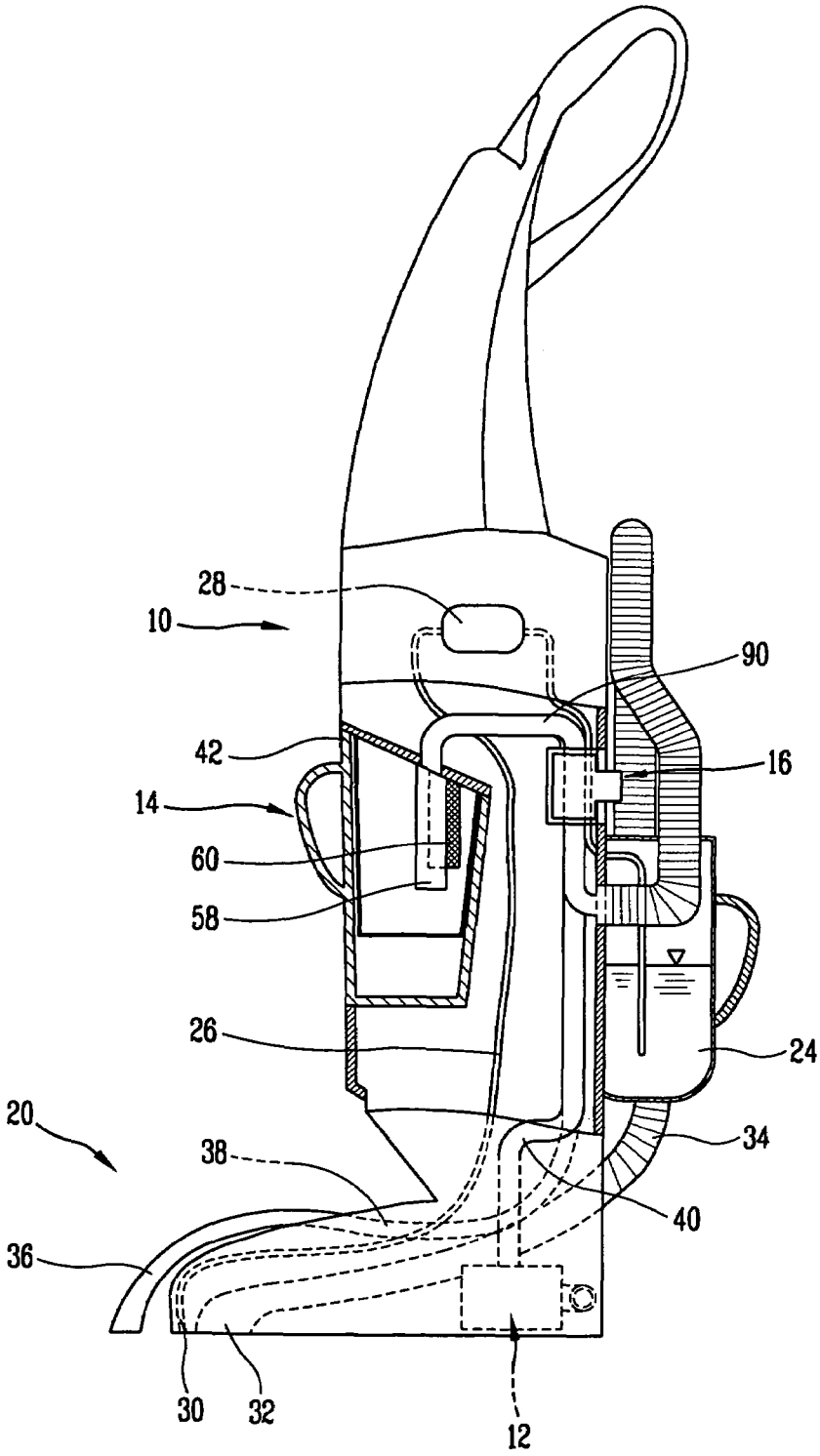
FIG. 2 is a section view showing the complex type cleaner according to one embodiment of the present invention.

FIG. 1 is a disassembled perspective view showing a complex type cleaner according to one embodiment of the present invention, and FIG. 2 is a section view showing the complex type cleaner according to one embodiment of the present invention.

The complex type cleaner according to one embodiment of the present invention comprises: a body 10; a suction head 20 arranged at a lower side of the body 10, for sucking dust at the time of performing a vacuum cleaning and sucking dirty water at the time of performing a water cleaning; a suction fan 12 for generating a suction force so that dust and dirty water can be sucked into the suction head 20; a reservoir 14 detachably mounted at the body 10 and storing dust or dirty water; and a valve assembly 16 for converting a cleaning mode into a vacuum cleaning mode or a water cleaning mode by selectively opening and closing passages connected among the reservoir 14, the suction head 20, and the suction fan 12.

The body 10 is provided with a handgrip 18 at an upper side thereof, and a mounting portion 22 for detachably mounting the reservoir 14 in which dust or dirty water is collected is formed at a front side of the body 10.

Also, a clean water spray device for spraying clean water to a carpet or a floor at the time of performing a water cleaning is installed at the body 10.

The clean water spray device includes: a water tank 24 mounted at a rear surface of the body 10 and storing clean water; a clean water supplying line 26 connected to the water tank 24 and supplying clean water to the suction head 20; a pump 28 installed at the clean water supplying line 26 and pumping the clean water stored in the water tank 24; and a spray nozzle 30 connected to the end of the clean water supplying line 26 and spraying the clean water pumped by the pump 28 to a carpet.

A dust suction opening 32 for sucking dust and foreign materials is formed at a lower surface of the suction head 20, and a dust suction tube 34 for guiding dust sucked into the dust suction opening 32 to the reservoir 14 is connected to a rear side of the suction head 20. The dust suction tube 34 is preferably formed as a bellows with consideration of a flowing characteristic of a fluid.

A suction nozzle 36 for sucking water that has been sprayed from the clean water spray device and then has been used to clean a carpet or a floor when the cleaner is in a water cleaning mode is mounted at a front side of the suction head 20. A water suction tube 38 for dirty water sucked into the suction nozzle 36 to the reservoir 14 is connected to the suction nozzle 36.

The water suction tube 38 is preferably formed as a smooth tube type in order to facilitate to suck water. Also, the suction nozzle 36 is preferably horizontally arranged at the front side of the suction head 20 where the dust suction opening 32 is formed.

The suction fan 12 is installed in the suction head 20, and is connected to the valve assembly by a discharge tube 40 thereby to generate a suction force for sucking dust or water through the suction head 20.

Figure 3:
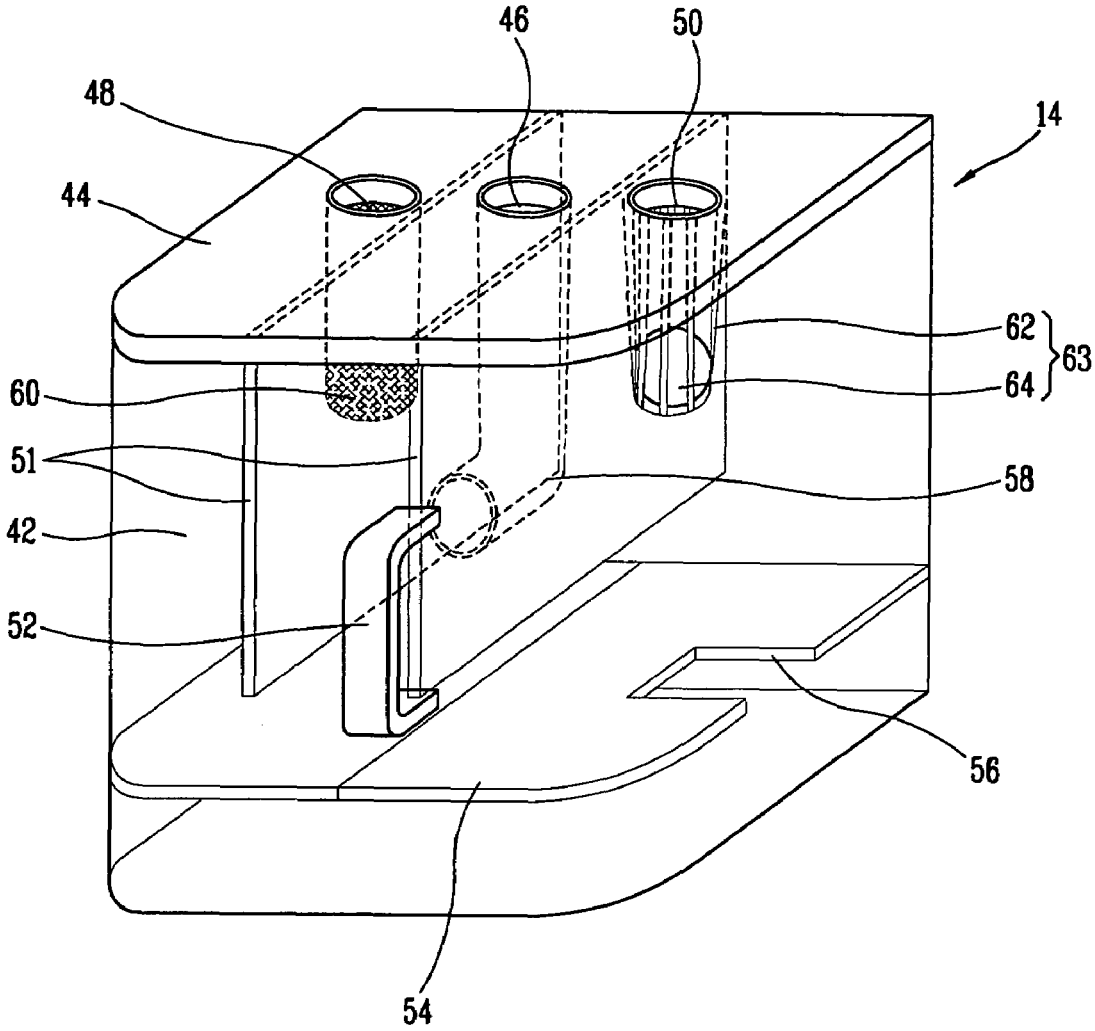
FIG. 3 is a perspective view showing a reservoir of the complex type cleaner according to one embodiment of the present invention.

As shown in FIG. 3, the reservoir 14 includes: a container 42 mounted at the mounting portion 22 of the body 10 and having a space for storing dust or water therein; a cover 44 mounted at an opened upper surface of the container 42; an inlet 46 formed at the cover 44 and selectively connected to a dust suction tube 34 or a water suction tube 38 by the valve assembly 16, for introducing dust or water into the container 42; a first outlet 48 formed at the cover 44 and connected to the discharge tube 40 connected to the suction fan by the valve assembly 16, for exhausting air inside the container 42 when dust is introduced to the container through the inlet 46; and a second outlet 50 formed at the cover 44 and connected to the discharge tube 40 by the valve assembly 16, for exhausting air inside the container 42 when dirty water is introduced to the container through the inlet 46.

The container 42 is provided with a handgrip 52 at the front surface thereof, and a scatter preventing plate 54 for preventing dust collected at the floor of the container 42 from scattering through the first outlet 48 is installed in the container 42.

The scatter preventing plate 54 is arranged in a horizontal direction with a certain gap from the floor of the container 42 thereby to divide the inside of the container 42 into an upper chamber and a lower chamber. A passage 56 for introducing dust and water into the lower chamber is formed at one side of the scatter preventing plate 54.

A water exhaustion preventing tube 58 for preventing water introduced into the inlet 46 from being exhausted to the second outlet 50 is connected to the inside of the inlet 46 formed at the cover 44. The water exhaustion preventing tube 58 has an upper end formed as a curved tube connected to the inlet 46 thereby to prevent water sucked into the inlet 46 from being exhausted.

A partition plate 51 is installed between the inlet 46 and the first outlet 48 and between the inlet 46 and the second outlet 50 in a vertical direction thereby to prevent water sucked into the inlet 46 from flowing to the first outlet 48 and the second outlet 50. The partition plate 51 is preferably mounted at a lower surface of the cover 44 in a vertical direction.

The first outlet 48 is provided with a filter 60 for preventing dust and foreign materials collected into the container 42 from being exhausted to the outside through the first outlet 48.

The second outlet 50 is provided with a water exhaustion preventing unit 63 for preventing water stored in the container 42 from being exhausted through the second outlet 50.

The water exhaustion preventing unit 63 is composed of: a housing 62 fixed to a lower surface of the cover 44 and arranged in the container 42 in a vertical direction; and a floater 64 arranged in the housing 62 to be movable up and down, and floating when water is filled in the container 42 and thereby blocking the second outlet 50.

Figure 4:
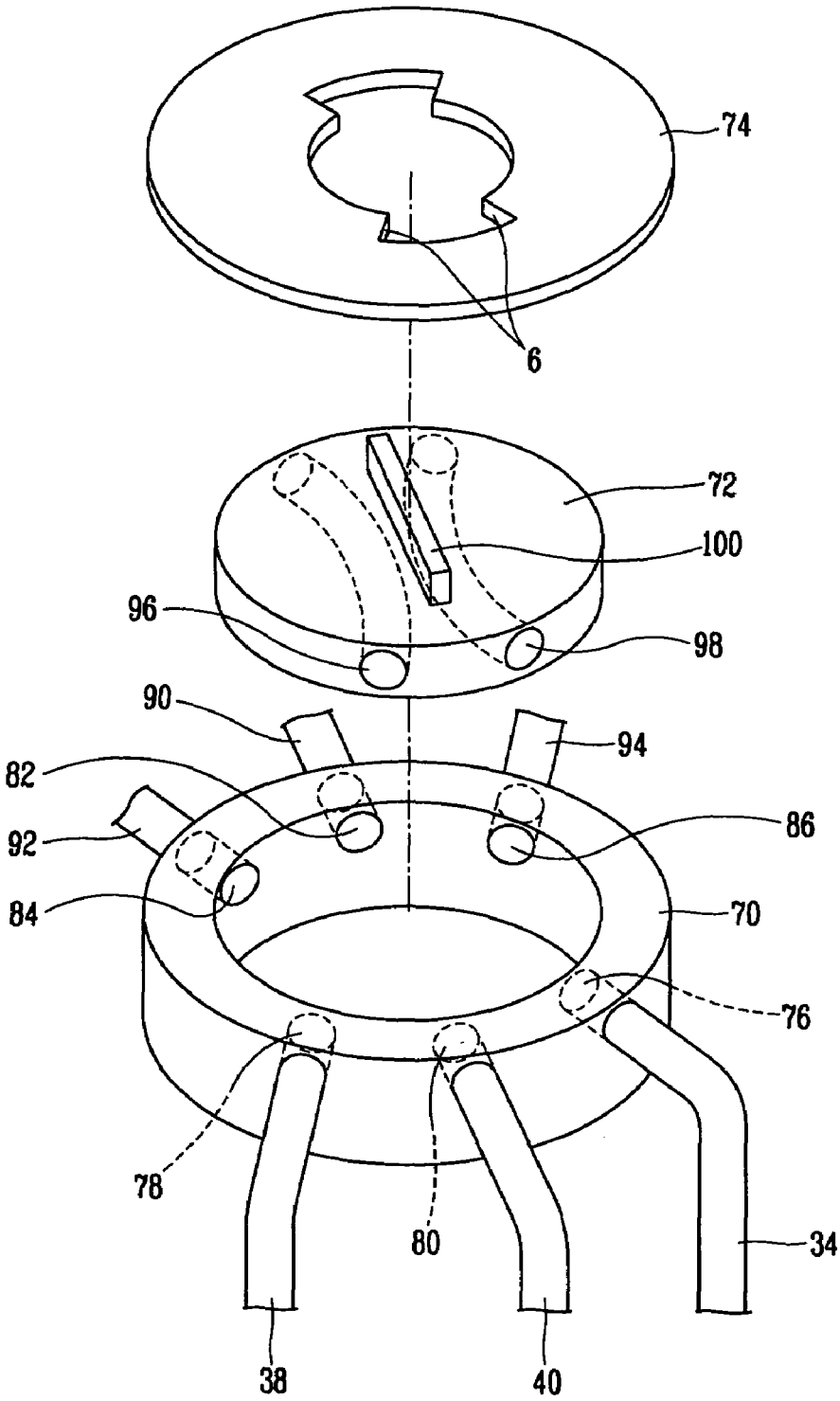
FIG. 4 is a perspective view showing a valve assembly of the complex type cleaner according to one embodiment of the present invention.

As shown in FIG. 4, the valve assembly 16 is composed of: a valve housing 70 mounted at the body 10 and having a plurality of connection ports; a switching valve 72 rotatably mounted at an inner circumferential surface of the valve housing 70, for selectively opening and closing passages; and a valve cover 74 mounted at a front surface of the valve housing 70 and limiting a rotation range of the switching valve 72.

The valve housing 70 is formed as a cylindrical shape, and a plurality of connection ports are radially formed at the valve housing 70. The connection ports are composed of: a first connection port 76 connected to the dust suction tube 34; a second connection port 78 connected to the water suction tube 38; a third connection port 80 to which the discharge tube 40 connected to the suction fan 12 is connected; a fourth connection port 82 connected to the inlet 46 of the reservoir 14 by a first tube 90; a fifth connection port 84 connected to the first outlet 48 by a second tube 92; and a sixth connection port 86 connected to the second outlet 50 by a third tube 94.

The switching valve 72 is rotatably arranged at an inner circumferential surface of the valve housing 70 as a disc shape, and has a first conduit 96 for selectively connecting between the first connection port 76 and the fourth connection port 82 or between the third connection port 80 and the sixth connection port 86, and a second conduit 98 for selectively connecting between the third connection port 80 and the fifth connection port 84 or between the second connection port 78 and the fourth connection port 82. A handle 100 for manually rotating the switching valve 72 is mounted at an upper surface of the switching valve 72.

The valve cover 74 has a disc shape of which center is opened so as the handle 100 of the switching valve 72 can be exposed, and a stepping hole 6 for hooking the handle 100 and thereby limiting a rotation range of the switching valve 72 is formed at the opened portion.

An operation of the complex type cleaner according to the present invention will be explained as follows.

Figure 5:
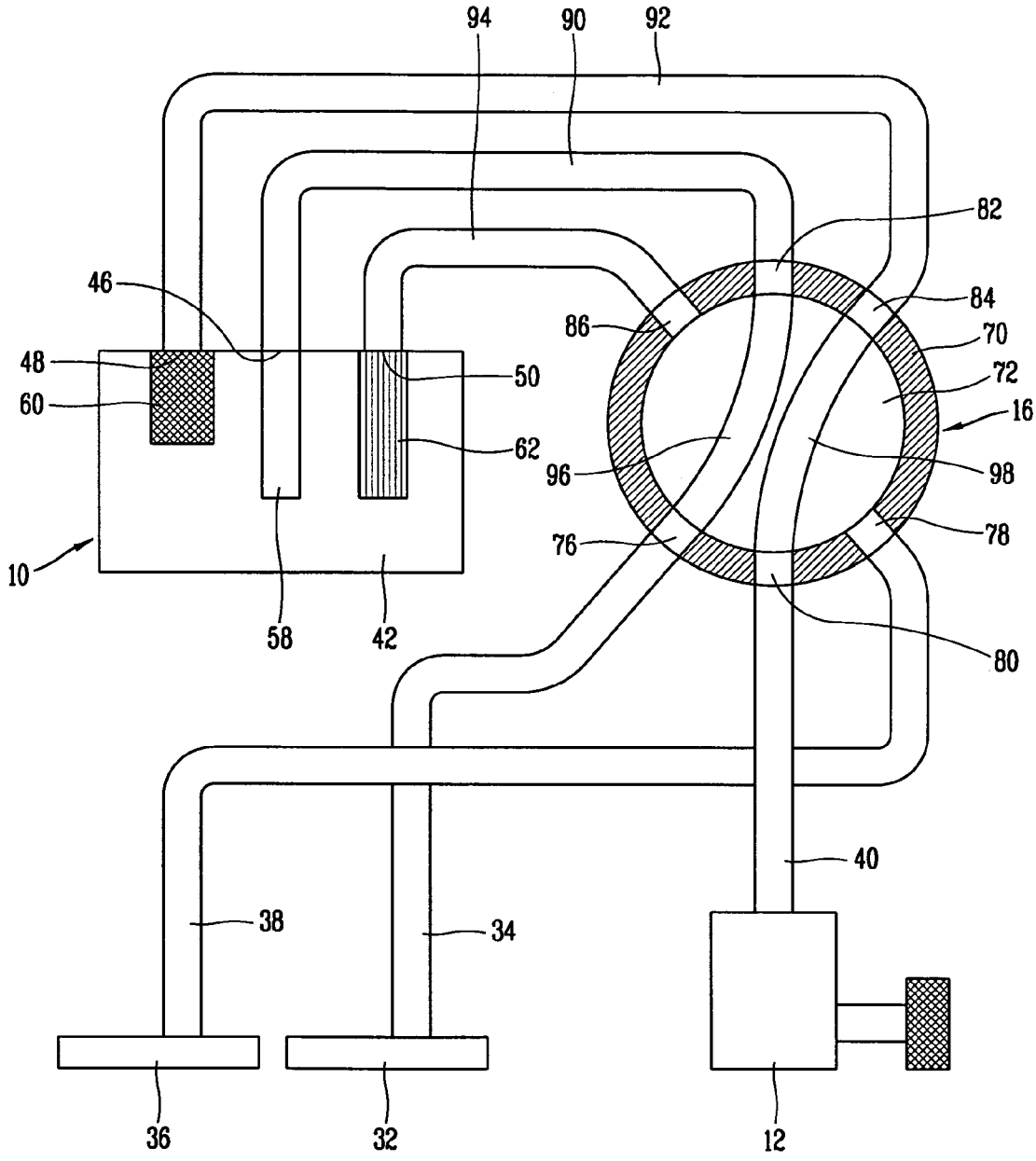
FIGS. 5 and 6 are construction views showing an operation state of the complex type cleaner according to one embodiment of the present invention.

FIG. 5 is a view showing an operation state of the complex type cleaner according to the present invention in a dust cleaning mode.

When the cleaner is to be used in a dust cleaning mode, the user selects a dust cleaning mode by turning the switching valve 72. According to this, the first conduit 96 of the switching valve 72 connects the first connection port 76 of the valve housing 70 and the fourth connection port 82 each other, and the second conduit 98 connects the third connection port 80 and the fifth connection port 84 each other. Under this state, when the suction fan 12 is driven, a suction force is generated thus to suck dust through the dust suction opening 32 of the suction head 20. The dust sucked into the dust suction opening 32 passes through the dust suction tube 34, the first conduit 96, and the first tube 90, and then is sucked into the container 42 through the inlet 46 of the reservoir 14.

The dust introduced into the inlet 46 is collected in the container 42, and only the air that has been filtered by the filter 60 is exhausted to the second tube 92 through the first outlet 48. At this time, the dust introduced into the container 42 is collected into a lower portion of the container 42 by the scatter preventing plate 54, and is prevented from scattering.

The air exhausted to the second tube 92 is sucked into the suction fan 12 by the second conduit 98 and the discharge tube 40, and then is exhausted to the outside.

Figure 6:
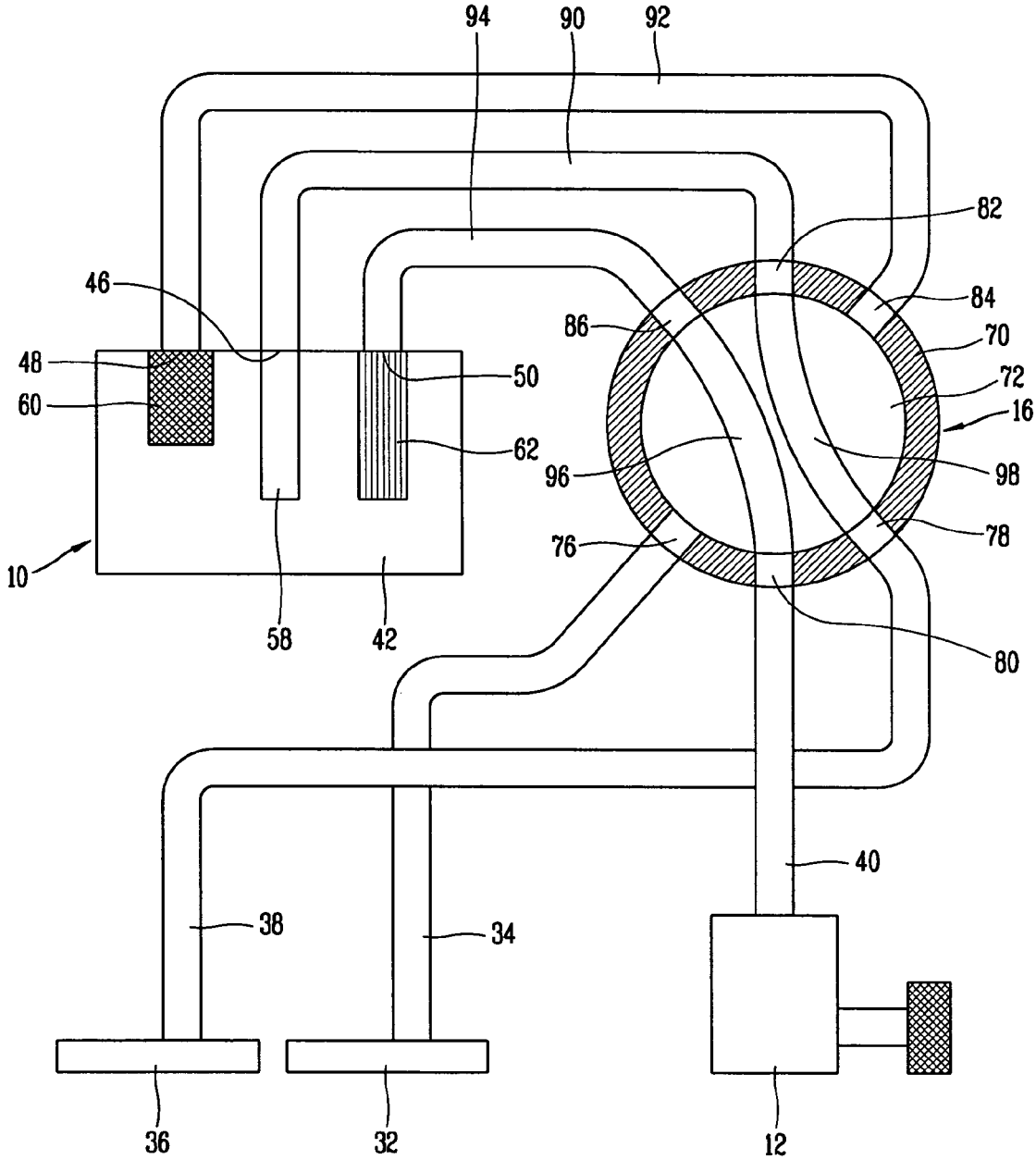

FIG. 6 is a view showing an operation state of the complex type cleaner according to the present invention in a water cleaning mode.

When the cleaner is to be used in a water cleaning mode, the user selects a water cleaning mode by turning the switching valve 72. According to this, the first conduit 96 of the switching valve 72 connects the third connection port 80 and the sixth connection port 86 each other, and the second conduit 98 connects the second connection port 78 and the fourth connection port 84 each other.

Under this state, when the suction fan 12 is driven, a suction force is generated thus to suck dirty water that has performed a floor cleaning into the suction nozzle 36. The dirty water sucked into the suction nozzle 36 passes through the water suction tube 38, the second conduit 98, and the first tube 90, and then is introduced into the container 42 through the inlet 46. According to this, the dirty water is stored in the container 42, and the air inside the container 42 is exhausted through the second outlet 50.

The water stored in the container 42 is prevented from being exhausted through the second outlet 50 by the water exhaustion preventing unit 63 mounted at the second outlet 50.

Effects of the complex type cleaner according to the present invention will be explained as follows.

In the complex type cleaner according to the present invention, a vacuum cleaning function for sucking dust and a water cleaning function are implemented at one cleaner, thereby reducing the cost and facilitating the usage and the storage.

Also, since the valve assembly for converting a cleaning mode of the cleaner into a vacuum cleaning mode or a water cleaning mode by selectively opening and closing passages is provided, the usage is facilitated.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A complex type cleaner comprising:

a body;

a suction head arranged at a lower side of the body, for sucking dust at the time of performing a vacuum cleaning and sucking dirty water at the time of performing a water cleaning;

a suction fan for generating a suction force so that dust and dirty water can be sucked into the suction head;

a reservoir detachably mounted at the body and storing dust or dirty water, the reservoir including an inlet;

a dust suction tube for guiding dust sucked into the suction head to the reservoir;

a water suction tube for guiding dirty water sucked into the suction head into the reservoir; and a valve assembly for converting a cleaning mode into a vacuum cleaning mode or a water cleaning mode by selectively connecting the dust suction tube to the inlet of the reservoir and the water suction tube to the inlet of the reservoir.

2. The complex type cleaner of claim 1 further comprising a clean water spray device for spraying clean water to a carpet or a floor at the time of performing a water cleaning.

3. The complex type cleaner of claim 2, wherein the clean water spray device includes:

a water tank mounted at a rear surface of the body and storing clean water;

a clean water supplying line connected to the water tank and supplying clean water to the suction head;

a pump installed at the clean water supplying line and pumping the clean water stored in the water tank; and a spray nozzle connected to an end of the clean water supplying line and spraying the clean water pumped by the pump to a carpet.

4. The complex type cleaner of claim 1, wherein a dust suction opening for sucking dust and foreign materials is formed at a lower surface of the suction head, the dust suction tube for guiding dust sucked into the dust suction opening to the reservoir is connected to a rear side of the suction head, a suction nozzle for sucking water that has been used to remove foreign materials of a floor is installed at a front side of the suction head, and the water suction tube for guiding dirty water sucked into the suction nozzle into the reservoir is connected to the suction nozzle.

5. The complex type cleaner of claim 4, wherein the dust suction tube is formed as a bellows.

6. The complex type cleaner of claim 4, wherein the water suction tube is formed of a smooth tube.

7. The complex type cleaner of claim 1, wherein the reservoir includes:

a container mounted at the body and having a space for storing dust or water therein;

a cover mounted at an opened upper surface of the container;

the inlet formed at the cover and selectively connected to the dust suction tube or the water suction tube by the valve assembly, for introducing dust or water into the container;

a first outlet formed at the cover and exhausting air inside the container when dust is introduced to the container through the inlet; and a second outlet formed at the cover and exhausting air inside the container when dirty water is introduced to the container through the inlet.

8. The complex type cleaner of claim 7, wherein the container is provided with a handgrip at a front surface thereof, and a scatter preventing plate for preventing dust collected at a floor of the container from scattering through the first outlet is installed in the container.

9. The complex type cleaner of claim 7, wherein a water exhaustion preventing tube for preventing water introduced into the inlet from being exhausted to the second outlet is connected to the inlet.

10. The complex type cleaner of claim 9, wherein the water exhaustion preventing tube is formed as a curved tube.

11. The complex type cleaner of claim 7, wherein the first outlet is provided with a filter for preventing dust and foreign materials collected into the container from being exhausted to outside through the first outlet.

12. The complex type cleaner of claim 7, wherein the second outlet is provided with a water exhaustion preventing unit for preventing water stored in the container from being exhausted through the second outlet.

13. The complex type cleaner of claim 12, wherein the water exhaustion preventing unit is composed of:

a housing fixed to a lower surface of the cover and arranged in the container in a vertical direction; and a floater arranged in the housing to be movable up and down, and floating when water is filled in the container and thereby blocking the second outlet.

14. The complex type cleaner of claim 7, wherein the valve assembly is composed of:

a valve housing mounted at the body and having a plurality of connection ports composed of a first connection port connected to the dust suction tube for sucking dust, a second connection port connected to the water suction tube for sucking water, a third connection port to which a discharge tube connected to the suction fan is connected, a fourth connection port connected to the inlet by a first tube, a fifth connection port connected to the first outlet by a second tube, and a sixth connection port connected to the second outlet by a third tube;

a switching valve rotatably mounted at an inner circumferential surface of the valve housing, having a first conduit for selectively connecting between the first connection port and the fourth connection port or between the third connection port and the sixth connection port, and having a second conduit for selectively connecting between the third connection port and the fifth connection port or between the second connection port and the fourth connection port; and a valve cover mounted at the valve housing and limiting a rotation range of the switching valve.

15. The complex type cleaner of claim 14, wherein the valve housing is formed as a cylindrical shape, first, second and third connection ports are penetratingly formed at one side of the valve housing with a certain gap, and fourth, fifth and sixth connection ports are penetratingly formed at another side of the valve housing.

16. The complex type cleaner of claim 14, wherein the switching valve is formed as a disc shape, is provided with a first conduit and a second conduit at lateral surfaces thereof, and is provided with handles for manually rotating the switching valve at a front surface thereof.

17. The complex type cleaner of claim 16, wherein the valve cover is formed as a disc shape thus to be fixed to a lateral surface of the valve housing, and a stepping hole for hooking the handle and thereby limiting a rotation range of the switching valve is formed at the valve cover.

* * * * *